United States Patent [19]

Wilson et al.

[11] Patent Number: 4,683,075

[45] Date of Patent: Jul. 28, 1987

[54] AZEOTROPE-LIKE COMPOSITIONS OF TRICHLOROTRIFLUOROETHANE, METHANOL, NITROMETHANE, ACETONE, AND METHYL ACETATE

[75] Inventors: David P. Wilson, Williamsville; Hang T. Pham, North Tonawanda; Earl A. E. Lund, West Seneca; Rajat S. Basu, Williamsville; John W. Pelava, Kenmore, all of N.Y.

[73] Assignee: Allied Corporation, Morris Township, Morris County, N.J.

[21] Appl. No.: 888,668

[22] Filed: Jul. 23, 1986

[51] Int. Cl.[4] ..... C11D 7/50

[52] U.S. Cl. ..... 252/171; 252/172; 252/DIG. 9; 252/364; 134/42

[58] Field of Search ..... 252/67, 78.1, 171, 172, 252/DIG. 9, 364

[56] References Cited

U.S. PATENT DOCUMENTS

| | | | |
|---|---|---|---|
| 2,999,816 | 9/1961 | Bennett et al. | 252/171 |
| 3,573,213 | 3/1971 | Burt | 252/172 |
| 3,960,746 | 6/1976 | Gorski | 252/171 |
| 4,045,366 | 8/1977 | Figiel | 252/171 |
| 4,268,407 | 5/1981 | Hey et al. | 252/171 |

FOREIGN PATENT DOCUMENTS 48-33878 10/1973 Japan .

*Primary Examiner*—Robert A. Wax
*Attorney, Agent, or Firm*—Jay P. Friedenson

[57] ABSTRACT

Azeotrope-like compositions comprising of trichlorotrifluoroethane, methanol, nitromethane, acetone, and methyl acetate which are stable and have utility as vapor degreasing agents and as solvents in a variety of industrial cleaning applications including the defluxing of printed circuit boards.

12 Claims, No Drawings

AZEOTROPE-LIKE COMPOSITIONS OF TRICHLOROTRIFLUOROETHANE, METHANOL, NITROMETHANE, ACETONE, AND METHYL ACETATE

FIELD OF THE INVENTION

This invention relates to azeotrope-like mixtures of trichlorotrifluoroethane, methanol, nitromethane, acetone, and methyl acetate. These mixtures are useful as vapor degreasing agents and as solvents to remove rosin fluxes from printed circuit boards.

BACKGROUND OF THE INVENTION

Fluorocarbon solvents, such as trichlorotrifluoroethane, have attained widespread use in recent years as effective, nontoxic, and nonflammable agents useful in degreasing applications. Trichlorotrifluoroethane in particular has been found to have satisfactory solvent power for greases, oils, waxes and the like. Trichlorotrifluoroethane also finds wide use in removing solder fluxes from printed wiring boards and printed wiring assemblies in the electronics industry. Such circuit boards normally consist of a glass fiber reinforced plate of electrically resistant plastic having electrical circuit traces on one or both sides thereof. The circuit traces are thin flat strips of conductive metal, usually copper, which serve to interconnect the electronic components attached to the printed wiring board. The electrical integrity of the contacts between the circuit traces and the components is assured by soldering.

Current industrial processes of soldering circuit boards involve coating the entire circuit side of the board with a flux and thereafter passing the coated side of the board through molten solder. The flux cleans the conductive metal parts and promotes a reliable intermetallic bond between component leads and circuit traces and lands on the printed wiring board. The preferred fluxes consist, for the most part, of rosin used alone or with activating additives such as dimethylamine hydrochloride, trimethylamine hydrochloride, or an oxalic acid derivative.

After soldering, which thermally degrades part of the rosin, the flux is removed from the board by means of an organic solvent. Trichlorotrifluoroethane, being nonpolar, adequately cleans rosin fluxes; however, it does not easily remove polar contaminants such as the activating additives.

To overcome this deficiency, trichlorotrifluoroethane has been mixed with polar components such as aliphatic alcohols or chlorocarbons such as methylene chloride. As example, U.S. Pat. No. 2,999,816 discloses the use of mixtures of 1,1,2-trichloro-1,2,2-trifluoroethane and methanol as defluxing solvents.

The art has looked, in particular, towards azeotropic compositions including the desired fluorocarbon components such as trichlorotrifluoroethane and other components which contribute additionally desired characteristics, such as polar functionality, hydrogen bonding strength, increased solvency power, and stability. Azeotropic compositions are desired because they exhibit a minimum boiling point and do not fractionate upon boiling. This is desirable because in vapor degreasing equipment with which these solvents are employed, redistilled material is generated for final rinse-cleaning. Thus, the vapor degreasing system acts as a still. Unless the solvent composition exhibits a constant boiling point, i.e., is an azeotrope or is azeotrope-like, fractionation will occur and undesirable solvent distribution may act to upset the cleaning and safety of processing. Preferential evaporation of the more volatile components of the solvent mixtures, which would be the case if they were not azeotropic or azeotrope-like, would result in mixtures with changed compositions which may have less desirable properties, such as lower solvency for rosin fluxes, less inertness towards the electrical components soldered on the printed circuit board, and increased flammability.

A number of trichlorotrifluoroethane based azeotrope compositions have been discovered which have been tested and in some cases employed as solvents for miscellaneous vapor degreasing and defluxing applications. For example, U.S. Pat. No. 3,573,213 discloses the azeotrope of 1,1,2-trichloro-1,2,2-trifluoroethane and nitromethane; U.S. Pat. No. 2,999,816 discloses an azeotropic composition of 1,1,2-trichloro-1,2,2-trifluoroethane and methanol; U.S. Pat. No. 3,960,746 discloses azeotrope-like compositions of 1,1,2-trichloro-1,2,2-trifluoroethane, methanol, and nitromethane; U.S. Pat. No. 4,268,407 discloses an azeotropic composition comprising of 1,1,2-trichloro-1,2,2-trifluoroethane, methanol, methyl acetate, and nitromethane; U.S. Pat. No. 4,045,366 discloses the ternary azeotrope of 1,1,2-trichloro-1,2,2-trifluoroethane, nitromethane and acetone, and Japanese Pat. No. 73-33878 discloses the ternary azeotrope of 1,1,2-trichloro-1,2,2-trifluoroethane, methanol, and acetone.

The art is continually seeking new fluorocarbon based azeotropic mixtures or azeotrope-like mixtures which offer alternatives for new and special applications for vapor degreasing and other cleaning applications.

It is accordingly an object of this invention to provide novel azeotrope-like compositions based on 1,1,2-trichloro-1,2,2-trifluoroethane which have good solvency power and other desirable properties for vapor degreasing applications and for the removal of solder fluxes from printed circuit boards.

Another object of the invention is to provide novel constant boiling or essentially constant boiling solvents which are liquid at room temperature, will not fractionate under conditions of use and also have the foregoing advantages.

A further object is to provide azeotrope-like compositions which are relatively nontoxic and nonflammable both in the liquid phase and the vapor phase. These and other objects and features of the invention will become more evident from the description which follows.

DESCRIPTION OF THE INVENTION

In accordance with the invention, novel azeotrope-like compositions have been discovered comprising trichlorotrifluoroethane, methanol, nitromethane, acetone and methyl acetate, with 1,1,2-trichloro-1,2,2-trifluoroethane being the trichlorotrifluoroethane of choice.

In one embodiment of the invention, the azeotrope-like compositions comprise from about 83.5 to about 93.8 weight percent of 1,1,2-trichloro-1,2,2-trifluoroethane, from about 5.1 to about 6.4 weight percent of methanol, from about 0.01 to about 1.0 weight percent of nitromethane, from about 0.3 to about 5.1 weight percent of acetone, and from about 0.1 to about 6.0 weight percent of methyl acetate.

In a preferred embodiment of the invention, the azeotrope-like compositions comprise from about 90.5 to about 93.5 weight percent of 1,1,2-trichloro-1,2,2-trifluoroethane, from about 5.7 to about 6.1 weight percent of methanol, from about 0.05 to about 0.2 weight percent of nitromethane, from about 0.4 to about 2.0 weight percent acetone, and from about 0.2 to about 1.7 weight percent methyl acetate.

In the most preferred embodiment of the invention, the azeotrope-like compositions comprise from about 91.4 to about 93.5 weight percent of 1,1,2-trichloro-1,2,2-trifluoroethane, from about 5.8 to about 6.0 weight percent of methanol, from about 0.03 to about 0.1 weight percent of nitromethane, from about 0.6 to about 1.2 weight percent acetone, and from about 0.4 to 1.2 weight percent methyl acetate. All of the above-described compositions possess constant or essentially constant boiling points of about 39.7° C.±0.2° C. at 760 mm Hg pressure. The precise azeotropic composition has not been determined but has been ascertained to be within the above ranges.

All compositions within the above-indicated ranges, as well as certain compositions outside the indicated ranges, are azeotrope-like, as defined more particularly below.

It has been found that these azeotrope-like compositions are stable, reasonably safe to use and that the preferred compositions of the invention are nonflammable (exhibit no flash point when tested by the Tag Open Cup test method—ASTM D1310-80) and exhibit excellent solvency power. These compositions have been found to be particularly effective when employed in conventional degreasing units for the dissolution of rosin fluxes and the cleaning of such fluxes from printed circuit boards.

For the purpose of this discussion, by azeotrope-like composition is intended to mean that the composition behaves like a true azeotrope in terms of its constant boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted to non-azeotrope-like compositions in which during boiling or evaporation, the liquid composition changes to a substantial degree.

As is well known in this art, another characteristic of azeotrope-like compositions is that there is a range of compositions containing the same components in varying proportions which are azeotrope-like. All such compositions are intended to be covered by the term azeotrope-like as used herein. As an example, it is well known that at differing pressures, the composition of a given azeotrope will vary at least slightly and changes in distillation pressures also change, at least slightly, the distillation temperatures. Thus, an azeotrope of A and B represents a unique type of relationship but with a variable composition depending on temperature and/or pressure.

The 1,1,2-trichloro-1,2,2-trifluoroethane, methanol, nitromethane, acetone, and methyl acetate components of the novel solvent azeotrope-like compositions of the invention are all commercially available. A suitable grade of 1,1,2-trichloro-1,2,2-trifluoroethane, for example, is sold by Allied Corporation under the trade name "GENESOLV® D".

EXAMPLES 1–5

The azeotrope-like compositions of the invention were determined through the use of distillation techniques designed to provide higher rectification of the distillate than found in most vapor degreaser systems. For this purpose a five plate Oldershaw distillation column was used with a cold water condensed, timer controlled magnetically activated liquid dividing head. Typically, approximately 350 cc of liquid were charged to the distillation pot. The liquid was a mixture comprised of various combinations of 1,1,2-trichloro-1,2,2-trifluoroethane, methanol, nitromethane, acetone, and methyl acetate. The mixture was heated at total reflux for about one hour to ensure equilibration. For most of the runs, the distillate was obtained using a 5:1 reflux ratio which increases rectification and at a boil-up rate of 250–300 grams per hr. Approximately 150 cc of product were distilled and 5 approximately equivalent sized overhead cuts were collected. The vapor temperature (of the distillate), pot temperature, and barometric pressure were monitored, A constant boiling fraction was collected and analyzed by gas chromatography to determine the weight percentages of its components.

To normalize observed boiling points during different days to 760 mm of mercury pressure, the approximate normal boiling points of 1,1,2-trichloro-1,2,2-trifluoroethane rich mixtures were estimated by applying a barometic correction factor of about 26 mm Hg/°C., to the observed values. However, it is to be noted that this corrected boiling point is generally accurate up to ±0.4° C. and serves only as a rough comparison of boiling points determined on different days. By the above-described method, it was discovered that a constant boiling mixture boiling at 39.7°±0.2° C. at 760 mm Hg was formed for compositions comprising about 90.5 to about 93.5 weight percent 1,1,2-trichloro-1,2,2-trifluoroethane (FC-113), about 5.8 to about 5.9 weight percent methanol (MeOH), about 0.01 to about 0.1 weight percent nitromethane, about 0.3 to about 2.0 weight percent acetone, and about 0.2 to 1.7 weight percent methyl acetate. Supporting distillation data for the mixtures studied are shown in Table I.

TABLE I

| | Starting Material (wt. %) | | | | |
|---|---|---|---|---|---|
| Example | FC-113 | MeOH | $MeNO_2$ | Acetone | Methyl Acetate |
| Distillation (5 plate) | | | | | |
| 1 | 83.5 | 5.1 | 0.3 | 5.1 | 6.0 |
| 2 | 91.5 | 6.0 | 0.1 | 1.2 | 1.2 |
| 3 | 92.8 | 5.9 | 0.3 | 0.6 | 0.4 |
| 4 | 92.5 | 5.8 | 0.2 | 0.9 | 0.6 |
| 5 | 91.3 | 5.9 | 0.3 | 1.8 | 0.6 |

| | Constant Boiling Fraction (wt. %) | | | | |
|---|---|---|---|---|---|
| Example | FC-113 | MeoH | $MeNO_2$ | Acetone | Methyl Acetate |
| 1 | 90.5 | 5.8 | 0.01 | 2.0 | 1.7 |
| 2 | 93.2 | 5.8 | 0.03 | 0.6 | 0.4 |
| 3 | 93.5 | 5.9 | 0.1 | 0.3 | 0.2 |
| 4 | 93.5 | 5.8 | 0.06 | 0.5 | 0.2 |
| 5 | 93.1 | 5.8 | 0.05 | 0.8 | 0.2 |

| Example | Vapor Temp (°C.) | Barometic Pressure (mm Hg) | Corrected Boiling Point to 760 mm Hg |
|---|---|---|---|
| 1 | 39.5 | 747.3 | 40.0 |

TABLE I-continued

| | | | |
|---|---|---|---|
| 2 | 39.2 | 747.8 | 39.7 |
| 3 | 38.8 | 743.5 | 39.5 |
| 4 | 39.0 | 743.5 | 39.7 |
| 5 | 39.3 | 751.0 | 39.7 |
| | | | 39.7° c. ± 0.2° C. |

From the above examples, it is readily apparent that additional constant boiling or essentially constant boiling mixtures of the same components can readily be identified by anyone of ordinary skill in this art by the method described. No attempt was made to fully characterize and define the true azeotrope in the system comprising 1,1,2-trichloro-1,2,2-trifluoroethane, methanol, nitromethane, acetone, and methyl acetate, nor the outer limits of its compositional ranges which are constant boiling or essentially constant boiling. As indicated, anyone of ordinary skill in the art can readily ascertain other constant boiling or essentially constant boiling mixtures, it being kept in mind that "constant boiling" or "essentially constant boiling" for the purposes of this invention means constant boiling or essentially constant boiling in the environment of a vapor degreaser system such as utilized in the art. All such mixtures in accordance with the invention which are constant boiling or essentially constant boiling are "azeotrope-like" within the meaning of this invention.

EXAMPLE 6

To illustrate the azeotrope-like nature of the mixtures of this invention under conditions of actual use in vapor phase degreasing operation, a vapor phase degreasing machine was charged with a preferred azeotrope-like mixture in accordance with the invention, comprising about 92.1 weight percent 1,1,2-trichloro-1,2,2-trifluoroethane (FC-113), about 5.8 weight percent methanol, about 0.1 weight percent nitromethane, about 1.2 weight percent acetone, and about 0.8 weight percent methyl acetate. The mixture was evaluated for its constant boiling or non-segregating characteristics. The vapor phase degreasing machine utilized was a small water-cooled, three-sump vapor phase degreaser with an attached still, which represents a type of system configuration comparable to machine types in the field today which would present the most rigorous test of solvent segregating behavior. Specifically, the degreaser employed to demonstrate the invention contains two overflowing rinse-sumps and a boil-sump. The sump adjacent to the boil-sump is referred to as the work sump. The boil-sump and the still are electrically heated, and each contains a low-level shut-off switch. Solvent vapors in both the degreaser and the still are condensed on water-cooled stainless-steel coils. The still is fed by gravity from the boil-sump. Condensate from the still is returned to the first rinse-sump, also by gravity. The capacity of the unit is approximately 3.5 gallons. This degreaser is very similar to Baron Blakeslee 2 LLV 3-sump degreasers with an attached still which are quite commonly used in commercial establishments.

The solvent charge was brought to reflux and the compositions in the rinse sump containing the clear condensate from the still, the work sump containing the overflow from the rinse sump, the boil sump where the overflow from the work sump is brought to the mixture boiling point, and the still were determined with a Perkin Elmer Sigma 3 gas chromatograph. The temperature of the liquid in the boil sump and still was monitored with a thermocouple temperature sensing device accurate to ±0.2° C. Refluxing was continued for 48 hours and sump compositions were monitored throughout this time. A mixture was considered constant boiling or non-segregating if the maximum concentration difference between sumps for any mixture component was ±2 sigma around the mean value. Sigma is a standard deviation unit and it is our experience from many observations of vapor degreaser performance that commercial "azeotrope-like" vapor phase degreasing solvents exhibit less than a ±2 sigma variation in composition with time and yet produce very satisfactory non-segregating cleaning behavior.

If the mixture were not azeotrope-like, the high boiling components would very quickly concentrate in the still and be depleted in the rinse sump. This did not happen. Also, the concentration of each component in the sumps stayed well within ±2 sigma. These results indicate that the compositions of this invention will not segregate in any types of large-scale commercial vapor degreasers, thereby avoiding potential safety, performance, and handling problems. The preferred composition tested was also found not to have a flash point according to recommended procedures ASTM D 56-79 (Tag Closed Cup) and ASTM D 1310-80 (Tag Open Cup).

EXAMPLE 7

This example illustrates the use of the preferred azeotrope-like composition of the invention to clean (deflux) printed wiring boards and printed wiring assemblies.

Three commercial rosin-based fluxes were used in this test. The fluxes were Alpha 611F (manufactured by Alpha Metals Inc.), Kester 1585-MIL (manufactured by Kester Solder), and Kenco 885 (manufactured by Kenco Industries Inc.). Predesigned printed wiring boards were fluxed in a Hollis 10-inch TDL wave solder machine. For Alpha 611F and Kester 1585-MIL fluxes, altogether twelve such test boards were prepared for defluxing. Of these, six contained some electronic components soldered to the board and the other six did not have any components on the board. For Kenco 885, eight boards were run; four with components and the other four without any components.

The printed wiring assemblies with electronic components (used in this test) were high density boards each having a one sided surface area of 18.97 square inches and containing two 36 pin dual in line packages (DIP), two 24 pin DIP's, five 16 pin DIP's and forty-one discrete components (resistors and capacitors).

Prior to fluxing and soldering, all specimens were pre-cleaned following a vigorous pre-cleaning schedule to ensure very low levels of contamination before fluxing. In our experiments, the determination of the ionic contaminants on printed wiring board surfaces was made with a Kenco® Omega-meter, which is a standard industry test method for cleanliness. The Kenco Omega-meter employs a 75/25 volume % mixture of isopropyl alcohol/water to rinse the printed wiring boards, and the changes in specific resistivity of the solution are monitored up to 30 minutes. Three resistivity readings were taken for each run: (i) the initial resistivity at time zero, (ii) the resistivity after 15 minutes, and (iii) the resistivity at 30 minutes. The raw data were converted to micrograms (mg) per square inch of ionic contaminants, which is expressed in the standard way in terms of equivalents of sodium chloride (NaCl).

Utilizing this technique, it was determined that all specimens used for our experiments would be precleaned to 0.05 mg or less of sodium chloride equivalent per square inch.

Cleaning (defluxing) was performed in a Branson B400R two-sump vapor degreaser. The first sump is used as the working sump and holds boiling solvent, and the second sump is used as the rinse sump. Refrigerated cooling coils line the upper wall of the apparatus to maintain a vapor blanket.

The cleaning schedule employed to demonstrate the usefulness of this invention was as follows: (i) two (2) minute exposure to the vapors over the boil sump, (ii) half a minute full immersion in the cold sump, (iii) half a minute re-exposure to the vapors over the boil sump.

After defluxing two replicate analyses of boards with no components and two replicate analyses of boards with components were made in the Kenco Omegameter. In the case of Alpha 611F and Kester 1585-MIL, each replicate analysis consisted of testing three boards together at the same time in the Omega meter test tank and in the case of Kenco 885 each replicate analysis consisted of testing two boards together at the same time in the Omega meter test tank.

The azeotrope-like composition used to illustrate the usefulness of the invention to deflux printed wiring boards was comprised of about 90.7 weight percent of 1,1,2-trichloro-1,2,2-trifluoroethane, about 5.7 weight percent of methanol, about 0.1 weight percent of nitromethane, about 1.9 weight percent of acetone, and about 1.6 weight percent of methyl acetate.

The cleaning performance of the azeotrope-like composition of this invention was also compared to that of two commercial defluxing solvents, Genesolv ® DMS and Freon ® TMS, where both commercial solvents consist of azeotrope-like compositions of trichlorotrifluoroethane, primary alcohol(s), and nitromethane. Genesolv ® DMS is a blend of 92.0 weight percent trichlorotrifluoroethane, 4.0 weight percent of methanol, 2.0 weight percent of ethanol, 1.0 weight percent of isopropyl alcohol, and 1.0 weight percent of nitromethane. Freon ® TMS is a blend of 94.05 weight percent of trichlorotrifluoroethane, 5.7 weight percent of methanol, and 0.25 weight percent of nitromethane. The following table summarizes the residual ionic contamination left on fluxed printed circuit boards cleaned by the above azeotrope-like composition of this invention, Genesolv ® DMS and Freon ® TMS.

TABLE II

| | | Performance Testing | | | |
|---|---|---|---|---|---|
| | | Residual Ionic Contamination (average of all runs) (mg NaCl/in$^2$) | | | |
| | | Boards with No Components | | Boards with Components | |
| Azeotrope-Like Solvent | Solder Flux | 15 min. | 30 min. | 15 min. | 30 min. |
| This invention | ALPHA 611 | 1.25 | 1.49 | 2.88 | 3.33 |
| Genesolv ® DMS | ALPHA 611 | 1.68 | 2.07 | 3.79 | 4.40 |
| Freon ® TMS | ALPHA 611 | 1.76 | 2.15 | 4.20 | 4.91 |
| This invention | Kester 1585-MIL | 3.50 | 4.16 | 7.00 | 8.06 |
| Genesolv ® DMS | Kester 1585-MIL | 5.96 | 6.92 | 12.38 | 14.29 |
| Freon ® TMS | Kester 1585-MIL | 8.64 | 9.75 | 19.38 | 21.37 |
| This invention | Kenco 885 | 7.26 | 9.02 | 15.28 | 18.27 |
| Genesolv ® DMS | Kenco 885 | 14.95 | 17.61 | 30.93 | 35.95 |
| Freon ® TMS | Kenco 885 | 9.67 | 11.24 | 27.72 | 31.51 |

As stated earlier, the industry has recognized that admixtures of trichlorotrifluoroethane with strongly hydrogen bonding components such as aliphatic alcohols, especially methanol, greatly enhance the ability of trichlorotrifluoroethane alone to remove the ionic activator components of rosin fluxes from printed wiring boards. Unexpectedly, we found that adding other solvents such as acetone and methyl acetate (which are not as strongly hydrogen bonding as methanol) to a mixture of trichlorotrifluoroethane, alcohol(s), and nitromethane produces an apparent synergistic effect which improves the cleaning ability of the blend. As the above example shows, particularly in the case of boards fluxed with highly activated rosin fluxes such as Kester 1585-MIL and Kenco 885, there is a statistically significant improvement in cleaning ability for the solvent of this invention over the two commercial defluxing solvents.

We claim:

1. Azeotrope-like compositions comprising trichlorotrifluoroethane, methanol, nitromethane, acetone and methyl acetate.

2. Azeotrope-like compositions according to claim 1 wherein said trichlorotrifluoroethane is 1,1,2-trichloro-1,2,2-trifluoroethane.

3. Azeotrope-like compositions according to claim 2 comprising from about 83.5 to about 93.8 weight percent 1,1,2-trichloro-1,2,2-trifluoroethane, from about 5.1 to about 6.4 weight percent methanol, from about 0.01 to about 1.0 weight percent nitromethane, from about 0.3 to about 5.1 weight percent acetone, and from about 0.1 to about 6.0 weight percent methyl acetate.

4. Azeotrope-like compositions according to claim 2 wherein said weight percent of 1,1,2-trichloro-1,2,2-trifluoroethane is from about 90.5 to about 93.5, said weight percent methanol is from about 5.7 to about 6.1, said weight percent nitromethane is from about 0.05 to about 0.2, said weight percent acetone is from about 0.4 to about 2.0, and said weight percent methyl acetate is from about 0.2 to about 1.7.

5. Azeotrope-like compositions according to claim 2 wherein said weight percent of 1,1,2-trichloro-1,2,2-trifluoroethane is from about 91.4 to about 93.5, said weight percent methanol is from about 5.8 to about 6.0, said weight percent nitromethane is from about 0.03 to about 0.1, said weight percent acetone is from about 0.6 to about 1.2, and said weight percent methyl acetate is from about 0.4 to about 1.2.

6. Azeotrope-like compositions according to claim 2 wherein said weight percent of 1,1,2-trichloro-1,2,2-trifluoroethane is about 92.1, said weight percent methanol is about 5.8, said weight percent nitromethane is about 0.1, said weight percent acetone is about 1.2, and said weight percent methyl acetate is about 0.8.

7. The method of cleaning a solid surface which comprises treating said surface with an azeotrope-like composition as defined in claim 1.

8. The method of cleaning a solid surface which comprises treating said surface with an azeotrope-like composition as defined in claim 2.

9. The method of cleaning a solid surface which comprises treating said surface with an azeotrope-like composition as defined in claim 3.

10. The method of cleaning a solid surface according to claim 7 in which the solid surface is a printed circuit board contaminated with solder flux.

11. The method of cleaning a solid surface according to claim 8 in which the solid surface is a printed circuit board contaminated with solder flux.

12. The method of cleaning a solid surface according to claim 9 in which the solid surface is a printed circuit board contaminated with solder flux.

* * * * *